US009918609B2

(12) United States Patent
Fountain et al.

(10) Patent No.: US 9,918,609 B2
(45) **Date of Patent: *Mar. 20, 2018**

(54) ROTATING DRUM FILTER FOR A DISHWASHING MACHINE

(75) Inventors: Jordan R. Fountain, Saint Joseph, MI (US); Rodney M. Welch, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 2262 days.

This patent is subject to a terminal disclaimer.

(21) Appl. No.: 12/910,203

(22) Filed: Oct. 22, 2010

(65) Prior Publication Data

US 2011/0146731 A1 Jun. 23, 2011

Related U.S. Application Data

(63) Continuation-in-part of application No. 12/643,394, filed on Dec. 21, 2009, now Pat. No. 8,746,261.

(51) Int. Cl.
*A47L 15/42* (2006.01)

(52) U.S. Cl.
CPC ..... *A47L 15/4202* (2013.01); *A47L 15/4206* (2013.01); *A47L 15/4208* (2013.01); *A47L 15/4225* (2013.01)

(58) Field of Classification Search
None
See application file for complete search history.

(56) References Cited

U.S. PATENT DOCUMENTS

| | | | |
|---|---|---|---|
| 1,617,021 | A | 2/1927 | Mitchell |
| 2,154,559 | A | 4/1939 | Bilde |
| 2,422,022 | A | 6/1947 | Koertge |
| 2,734,122 | A | 2/1956 | Flannery |
| 3,016,147 | A | 1/1962 | Cobb et al. |
| 3,026,628 | A | 3/1962 | Berger, Sr. et al. |
| 3,068,877 | A | 12/1962 | Jacobs |
| 3,103,227 | A | 9/1963 | Long |
| 3,122,148 | A | 2/1964 | Alabaster |
| 3,288,154 | A | 11/1966 | Jacobs |
| 3,542,594 | A | 11/1970 | Smith et al. |
| 3,575,185 | A | 4/1971 | Barbulesco |

(Continued)

FOREIGN PATENT DOCUMENTS

| | | |
|---|---|---|
| CH | 169630 | 6/1934 |
| CN | 2571812 Y | 9/2003 |

(Continued)

OTHER PUBLICATIONS

German Search Report for DE102010061347, dated Jan. 23, 2013.

(Continued)

*Primary Examiner* — Michael Barr
*Assistant Examiner* — Jason Riggleman
(74) *Attorney, Agent, or Firm* — McGarry Bair PC

(57) ABSTRACT

A dishwasher with a tub and a recirculation pump, which includes a housing defining a chamber and having an inlet fluidly coupled to the tub and an outlet fluidly coupled to the tub, an impeller rotatably mounted within the chamber and expelling liquid from the chamber through the outlet, and a filter fluidly disposed between the inlet and the outlet and operably coupled to the impeller for co-rotation.

32 Claims, 13 Drawing Sheets

(56) References Cited

U.S. PATENT DOCUMENTS

| | | | | |
|---|---|---|---|---|
| 3,586,011 | A | 6/1971 | Lamberto | |
| 3,739,145 | A | 6/1973 | Woehler | |
| 3,801,280 | A | 4/1974 | Shah et al. | |
| 3,846,321 | A | 11/1974 | Strange | |
| 3,906,967 | A | 9/1975 | Bergeson | |
| 3,989,054 | A | 11/1976 | Mercer | |
| 4,179,307 | A | 12/1979 | Cau et al. | |
| 4,180,095 | A | 12/1979 | Woolley et al. | |
| 4,326,552 | A | 4/1982 | Bleckmann | |
| 4,754,770 | A | 7/1988 | Fornasari | |
| 5,002,890 | A | 3/1991 | Morrison | |
| 5,030,357 | A | 7/1991 | Lowe | |
| 5,133,863 | A | 7/1992 | Zander | |
| 5,331,986 | A | 7/1994 | Lim et al. | |
| 5,454,298 | A | 10/1995 | Lu | |
| 5,470,142 | A | 11/1995 | Sargeant et al. | |
| 5,470,472 | A | 11/1995 | Baird et al. | |
| 5,557,704 | A | 9/1996 | Dennis et al. | |
| 5,569,383 | A | 10/1996 | Vander Ark, Jr. et al. | |
| 5,618,424 | A | 4/1997 | Nagaoka | |
| 5,711,325 | A | 1/1998 | Kloss et al. | |
| 5,755,244 | A | 5/1998 | Sargeant et al. | |
| 5,782,112 | A | 7/1998 | White et al. | |
| 5,803,100 | A | 9/1998 | Thies | |
| 5,865,997 | A | 2/1999 | Isaacs | |
| 5,868,937 | A | 2/1999 | Back et al. | |
| 5,904,163 | A | 5/1999 | Inoue et al. | |
| 5,924,432 | A | 7/1999 | Thies et al. | |
| 6,289,908 | B1 | 9/2001 | Kelsey | |
| 6,389,908 | B1 | 5/2002 | Chevalier et al. | |
| 6,460,555 | B1 | 10/2002 | Tuller et al. | |
| 6,491,049 | B1 | 12/2002 | Tuller et al. | |
| 6,601,593 | B2 | 8/2003 | Deiss et al. | |
| 6,666,976 | B2 | 12/2003 | Benenson, Jr. et al. | |
| 6,800,197 | B1 | 10/2004 | Kosola et al. | |
| 6,997,195 | B2 | 2/2006 | Durazzani et al. | |
| 7,047,986 | B2 | 5/2006 | Ertle et al. | |
| 7,069,181 | B2 | 6/2006 | Jerg et al. | |
| 7,093,604 | B2 | 8/2006 | Jung et al. | |
| 7,153,817 | B2 | 12/2006 | Binder | |
| 7,198,054 | B2 | 4/2007 | Welch | |
| 7,208,080 | B2 | 4/2007 | Batten et al. | |
| 7,232,494 | B2 | 6/2007 | Rappette | |
| 7,250,174 | B2 | 7/2007 | Lee et al. | |
| 7,270,132 | B2 | 9/2007 | Inui et al. | |
| 7,319,841 | B2 | 1/2008 | Bateman, III et al. | |
| 7,326,338 | B2 | 2/2008 | Batten et al. | |
| 7,347,212 | B2 | 3/2008 | Rosenbauer | |
| 7,350,527 | B2 | 4/2008 | Gurubatham et al. | |
| 7,363,093 | B2 | 4/2008 | King et al. | |
| 7,406,843 | B2 | 8/2008 | Thies et al. | |
| 7,445,013 | B2 | 11/2008 | VanderRoest et al. | |
| 7,497,222 | B2 | 3/2009 | Edwards et al. | |
| 7,523,758 | B2 | 4/2009 | Vanderroest et al. | |
| 7,594,513 | B2 | 9/2009 | VanderRoest et al. | |
| 7,819,983 | B2 | 10/2010 | Kim et al. | |
| 7,896,977 | B2 | 3/2011 | Gillum et al. | |
| 8,043,437 | B1 | 10/2011 | Delgado et al. | |
| 8,161,986 | B2 | 4/2012 | Allessandrelli | |
| 8,215,322 | B2 | 7/2012 | Fountain et al. | |
| 8,627,832 | B2 * | 1/2014 | Fountain et al. | 134/104.4 |
| 8,667,974 | B2 * | 3/2014 | Fountain et al. | 134/104.4 |
| 8,746,261 | B2 * | 6/2014 | Welch | 134/104.4 |
| 2002/0017483 | A1 | 2/2002 | Chesner et al. | |
| 2003/0037809 | A1 | 2/2003 | Favaro | |
| 2003/0205248 | A1 | 11/2003 | Christman et al. | |
| 2004/0007253 | A1 | 1/2004 | Jung et al. | |
| 2004/0103926 | A1 | 6/2004 | Ha | |
| 2005/0022849 | A1 | 2/2005 | Park et al. | |
| 2005/0133070 | A1 | 6/2005 | Vanderroest et al. | |
| 2006/0005863 | A1 | 1/2006 | Gurubatham et al. | |
| 2006/0054549 | A1 | 3/2006 | Schoendorfer | |
| 2006/0123563 | A1 | 6/2006 | Raney et al. | |
| 2006/0162744 | A1 | 7/2006 | Walkden | |
| 2006/0174915 | A1 | 8/2006 | Hedstrom et al. | |
| 2006/0236556 | A1 | 10/2006 | Ferguson et al. | |
| 2006/0237049 | A1 | 10/2006 | Weaver et al. | |
| 2007/0006898 | A1 | 1/2007 | Lee | |
| 2007/0107753 | A1 | 5/2007 | Jerg | |
| 2007/0163626 | A1 | 7/2007 | Klein | |
| 2007/0186964 | A1 | 8/2007 | Mason et al. | |
| 2007/0246078 | A1 | 10/2007 | Purtilo et al. | |
| 2007/0266587 | A1 | 11/2007 | Bringewatt et al. | |
| 2008/0116135 | A1 * | 5/2008 | Rieger et al. | 210/650 |
| 2008/0289654 | A1 | 11/2008 | Kim et al. | |
| 2008/0289664 | A1 | 11/2008 | Rockwell et al. | |
| 2009/0095330 | A1 | 4/2009 | Iwanaga et al. | |
| 2009/0283111 | A1 | 11/2009 | Classen et al. | |
| 2010/0012159 | A1 | 1/2010 | Verma et al. | |
| 2010/0043826 | A1 | 2/2010 | Bertsch et al. | |
| 2010/0043828 | A1 | 2/2010 | Choi et al. | |
| 2010/0043847 | A1 | 2/2010 | Yoon et al. | |
| 2010/0121497 | A1 | 5/2010 | Heisele et al. | |
| 2010/0154830 | A1 | 6/2010 | Lau et al. | |
| 2010/0154841 | A1 | 6/2010 | Fountain et al. | |
| 2010/0224223 | A1 | 9/2010 | Kehl et al. | |
| 2010/0252081 | A1 | 10/2010 | Classen et al. | |
| 2010/0300499 | A1 | 12/2010 | Han et al. | |
| 2011/0061682 | A1 | 3/2011 | Fountain et al. | |
| 2011/0126865 | A1 | 6/2011 | Yoon et al. | |
| 2011/0146714 | A1 | 6/2011 | Fountain | |
| 2011/0146730 | A1 | 6/2011 | Welch | |
| 2012/0097200 | A1 | 4/2012 | Fountain | |
| 2012/0138107 | A1 | 6/2012 | Fountain et al. | |

FOREIGN PATENT DOCUMENTS

| | | | |
|---|---|---|---|
| CN | 2761660 | Y | 3/2006 |
| CN | 1966129 | A | 5/2007 |
| CN | 2907830 | Y | 6/2007 |
| CN | 101406379 | A | 4/2009 |
| CN | 201276653 | Y | 7/2009 |
| CN | 201361486 | Y | 12/2009 |
| CN | 101654855 | A | 2/2010 |
| CN | 201410325 | Y | 2/2010 |
| CN | 201473770 | Y | 5/2010 |
| DE | 1134489 | | 8/1962 |
| DE | 1428358 | A1 | 11/1968 |
| DE | 1453070 | | 3/1969 |
| DE | 7105474 | | 8/1971 |
| DE | 7237309 | U | 9/1973 |
| DE | 2825242 | A1 | 1/1979 |
| DE | 3337369 | A1 | 4/1985 |
| DE | 3723721 | A1 | 5/1988 |
| DE | 3842997 | A1 | 7/1990 |
| DE | 4011834 | | 10/1991 |
| DE | 4016915 | A1 | 11/1991 |
| DE | 4131914 | A1 | 4/1993 |
| DE | 9415486 | U1 | 11/1994 |
| DE | 9416710 | U | 12/1994 |
| DE | 4418523 | A1 | 11/1995 |
| DE | 4433842 | C1 | 3/1996 |
| DE | 69111365 | T2 | 3/1996 |
| DE | 4413432 | C1 | 8/1996 |
| DE | 19546965 | A1 | 6/1997 |
| DE | 69403957 | T2 | 1/1998 |
| DE | 19652235 | A1 | 6/1998 |
| DE | 10000772 | A1 | 7/2000 |
| DE | 69605965 | T2 | 8/2000 |
| DE | 19951838 | A1 | 5/2001 |
| DE | 10065571 | A1 | 7/2002 |
| DE | 10106514 | A1 | 8/2002 |
| DE | 60206490 | T2 | 5/2006 |
| DE | 60302143 | | 8/2006 |
| DE | 102005023428 | A1 | 11/2006 |
| DE | 102005038433 | A1 | 2/2007 |
| DE | 102007007133 | A1 | 8/2008 |
| DE | 102007060195 | A1 | 6/2009 |
| DE | 202010006739 | U1 | 8/2010 |
| DE | 102009027910 | A1 | 1/2011 |
| DE | 102009028278 | A1 | 2/2011 |
| DE | 102010061215 | | 6/2011 |
| DE | 102011052846 | A1 | 5/2012 |
| DE | 102012103435 | A1 | 12/2012 |

(56) References Cited

FOREIGN PATENT DOCUMENTS

| | | | | |
|---|---|---|---|---|
| EP | 0068974 | A1 | 1/1983 | |
| EP | 0178202 | A1 | 4/1986 | |
| EP | 0198496 | A1 | 10/1986 | |
| EP | 0208900 | A2 | 1/1987 | |
| EP | 0370552 | | 5/1990 | |
| EP | 0374616 | A1 | 6/1990 | |
| EP | 0383028 | A2 | 8/1990 | |
| EP | 0405627 | A1 | 1/1991 | |
| EP | 437189 | A1 | 7/1991 | |
| EP | 0454640 | A1 | 10/1991 | |
| EP | 0521815 | A1 | 1/1993 | |
| EP | 0585905 | A2 | 3/1994 | |
| EP | 0597907 | B1 | 12/1995 | |
| EP | 0702928 | A1 | 3/1996 | |
| EP | 0725182 | A1 | 8/1996 | |
| EP | 0748607 | A2 | 12/1996 | |
| EP | 0752231 | A1 | 1/1997 | |
| EP | 752231 | A1 | 1/1997 | |
| EP | 0752231 | A1 * | 1/1997 | ..... A47L 15/42 |
| EP | 0854311 | A2 | 7/1998 | |
| EP | 0855165 | A2 | 7/1998 | |
| EP | 0898928 | A1 | 3/1999 | |
| EP | 1029965 | A1 | 8/2000 | |
| EP | 1224902 | A2 | 7/2002 | |
| EP | 1256308 | A2 | 11/2002 | |
| EP | 1264570 | A1 | 12/2002 | |
| EP | 1319360 | A1 | 6/2003 | |
| EP | 1342827 | A1 | 9/2003 | |
| EP | 1346680 | A2 | 9/2003 | |
| EP | 1386575 | A1 | 2/2004 | |
| EP | 1415587 | A1 | 5/2004 | |
| EP | 1498065 | A1 | 1/2005 | |
| EP | 1743871 | A1 | 1/2007 | |
| EP | 1862104 | A1 | 12/2007 | |
| EP | 1882436 | A1 | 1/2008 | |
| EP | 1583455 | B1 | 8/2008 | |
| EP | 1980193 | A1 | 10/2008 | |
| EP | 2127587 | A1 | 2/2009 | |
| EP | 2075366 | A1 | 7/2009 | |
| EP | 2138087 | A1 | 12/2009 | |
| EP | 2351507 | | 12/2010 | |
| EP | 1703834 | B1 | 2/2011 | |
| EP | 2332457 | A1 | 6/2011 | |
| EP | 2335547 | | 6/2011 | |
| EP | 2338400 | | 6/2011 | |
| FR | 1370521 | A | 8/1964 | |
| FR | 2372363 | A1 | 6/1978 | |
| FR | 2491320 | A1 | 4/1982 | |
| FR | 2491321 | A1 | 4/1982 | |
| FR | 2790013 | A1 | 8/2000 | |
| GB | 973859 | A | 10/1964 | |
| GB | 1047948 | | 11/1966 | |
| GB | 1123789 | A | 8/1968 | |
| GB | 1515095 | | 6/1978 | |
| GB | 2274772 | A | 8/1994 | |
| JP | 55039215 | A | 3/1980 | |
| JP | 60069375 | A | 4/1985 | |
| JP | 61085991 | A | 5/1986 | |
| JP | 61200824 | A | 9/1986 | |
| JP | 1005521 | A | 1/1989 | |
| JP | 1080331 | A | 3/1989 | |
| JP | 5245094 | A | 9/1993 | |
| JP | 07178030 | | 7/1995 | |
| JP | 10109007 | A | 4/1998 | |
| JP | 2000107114 | A | 4/2000 | |
| JP | 2001190479 | A | 7/2001 | |
| JP | 2001190480 | A | 7/2001 | |
| JP | 2003336909 | A | 12/2003 | |
| JP | 2003339607 | A | 12/2003 | |
| JP | 2004267507 | A | 9/2004 | |
| JP | 2005124979 | A | 5/2005 | |
| JP | 2006075635 | A | 3/2006 | |
| JP | 2007068601 | A | 3/2007 | |
| JP | 2008093196 | A | 4/2008 | |
| JP | 2008253543 | A | 10/2008 | |
| JP | 2008264018 | A | 11/2008 | |
| JP | 2008264724 | A | 11/2008 | |
| JP | 2010035745 | A | 2/2010 | |
| JP | 2010187796 | A | 9/2010 | |
| KR | 2001-0077128 | | 8/2001 | |
| KR | 2009-0006659 | | 1/2009 | |
| WO | 2005058124 | A1 | 6/2005 | |
| WO | 2005115216 | A1 | 12/2005 | |
| WO | 2007024491 | A2 | 3/2007 | |
| WO | 2007074024 | A1 | 7/2007 | |
| WO | 2008067898 | A1 | 6/2008 | |
| WO | 2008125482 | | 10/2008 | |
| WO | 2009018903 | A1 | 2/2009 | |
| WO | 2009065696 | A1 | 5/2009 | |
| WO | 2009077266 | A1 | 6/2009 | |
| WO | 2009077279 | A2 | 6/2009 | |
| WO | 2009077280 | A1 | 6/2009 | |
| WO | 2009077283 | A1 | 6/2009 | |
| WO | 2009077286 | A1 | 6/2009 | |
| WO | 2009077290 | A1 | 6/2009 | |
| WO | 2009118308 | A1 | 10/2009 | |

OTHER PUBLICATIONS

German Search Report for DE102010061215, dated Feb. 7, 2013.
European Search Report for EP12188007, dated Aug. 6, 2013.
German Search Report for DE102013103264, dated Jul. 12, 2013.
German Search Report for DE102013103625, dated Jul. 19, 2013.
German Search Report for DE102010061343, dated Jul. 7, 2011.
German Search Report for DE102010061342, dated Aug. 19, 2011.
European Search Report for Corresponding EP 12191467.5, dated Dec. 5, 2012.
German Search Report for DE102011053666, dated Oct. 21, 2011.
German Search Report for Counterpart DE102013109125, dated Dec. 9, 2013.
European Search Report for EP11188106, dated Mar. 29, 2012.
German Search Report for DE102010061346, dated Sep. 30, 2011.
Ishihara et al., JP 11155792 A, English Machine Translation, 1999, pp. 1-14.
German Search Report for Counterpart DE102014101260.7, dated Sep. 18, 2014.

* cited by examiner

ROTATING DRUM FILTER FOR A DISHWASHING MACHINE

CROSS-REFERENCE TO RELATED APPLICATIONS

The present application is a continuation-in-part of U.S. application Ser. No. 12/643,394, filed Dec. 21, 2009, now U.S. Pat. No. 8,746,261, issued Jun. 10, 2014, and which is incorporated by reference herein in its entirety.

BACKGROUND OF THE INVENTION

A dishwashing machine is a domestic appliance into which dishes and other cooking and eating wares (e.g., plates, bowls, glasses, flatware, pots, pans, bowls, etc.) are placed to be washed. A dishwashing machine includes various filters to separate soil particles from wash fluid.

SUMMARY OF THE INVENTION

The invention relates to a dishwasher with a tub defining a washing chamber for receiving dishes for cleaning and a recirculation pump. The recirculation pump includes a housing defining a chamber and having an inlet fluidly coupled to the tub and an outlet fluidly coupled to the tub, an impeller rotatably mounted within the chamber and expelling liquid from the chamber through the outlet, and a filter fluidly disposed between the inlet and the outlet and operably coupled to the impeller for co-rotation. The liquid in the tub is recirculated by actuating the recirculation pump such that the liquid is drawn into the chamber through the inlet, passes through the rotating filter, and is expelled by the rotating impeller through the outlet to the tub.

DESCRIPTION OF EMBODIMENTS OF THE INVENTION

Figure 1:
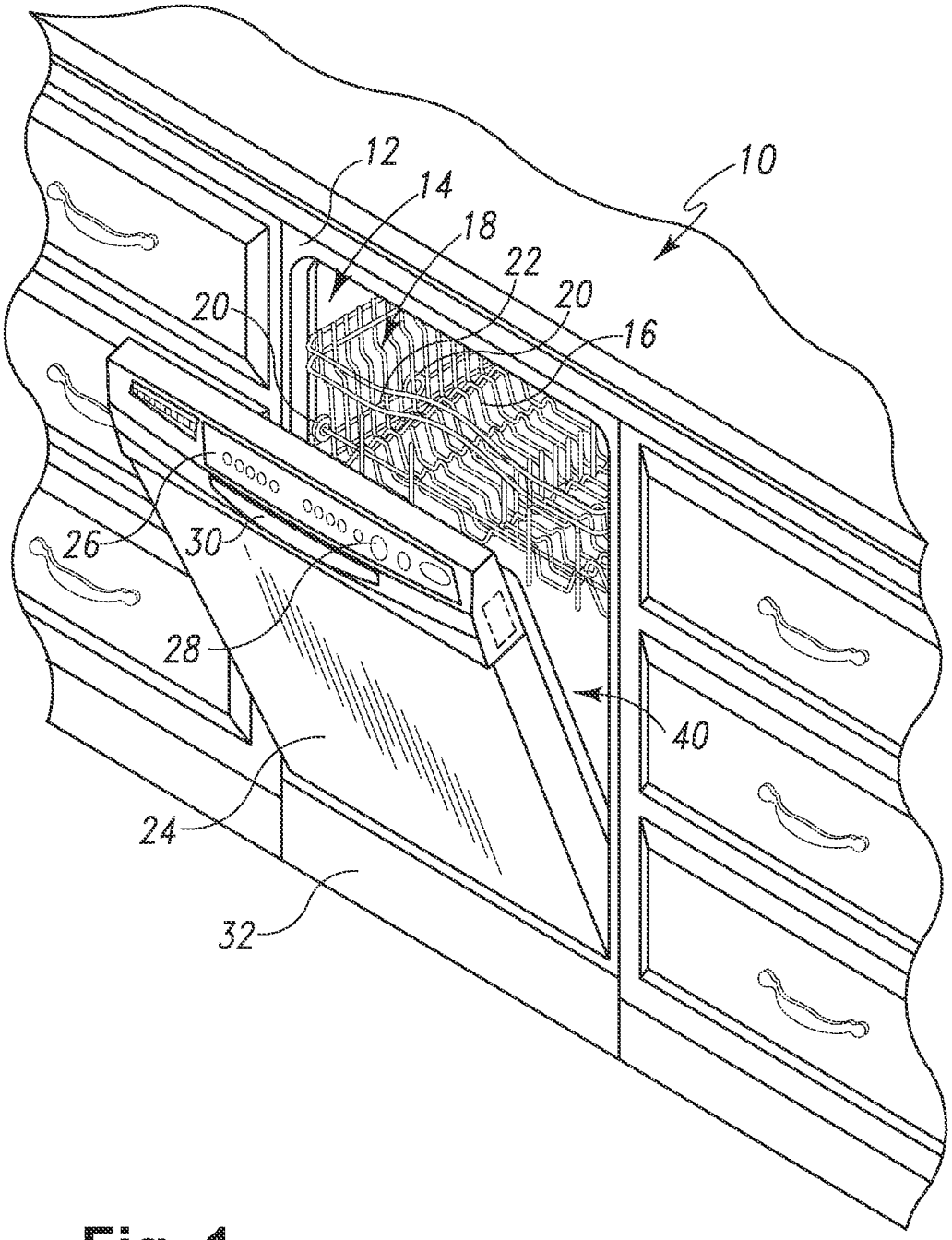
FIG. 1 is a perspective view of a dishwashing machine.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring to FIG. 1, a dishwashing machine 10 (hereinafter dishwasher 10) is shown. The dishwasher 10 has a tub 12 that defines a washing chamber 14 into which a user may place dishes and other cooking and eating wares (e.g., plates, bowls, glasses, flatware, pots, pans, bowls, etc.) to be washed. The dishwasher 10 includes a number of racks 16 located in the tub 12. An upper dish rack 16 is shown in FIG. 1, although a lower dish rack is also included in the dishwasher 10. A number of roller assemblies 18 are positioned between the dish racks 16 and the tub 12. The roller assemblies 18 allow the dish racks 16 to extend from and retract into the tub 12, which facilitates the loading and unloading of the dish racks 16. The roller assemblies 18 include a number of rollers 20 that move along a corresponding support rail 22.

A door 24 is hinged to the lower front edge of the tub 12. The door 24 permits user access to the tub 12 to load and unload the dishwasher 10. The door 24 also seals the front of the dishwasher 10 during a wash cycle. A control panel 26 is located at the top of the door 24. The control panel 26 includes a number of controls 28, such as buttons and knobs, which are used by a controller (not shown) to control the operation of the dishwasher 10. A handle 30 is also included in the control panel 26. The user may use the handle 30 to unlatch and open the door 24 to access the tub 12.

Figure 2:
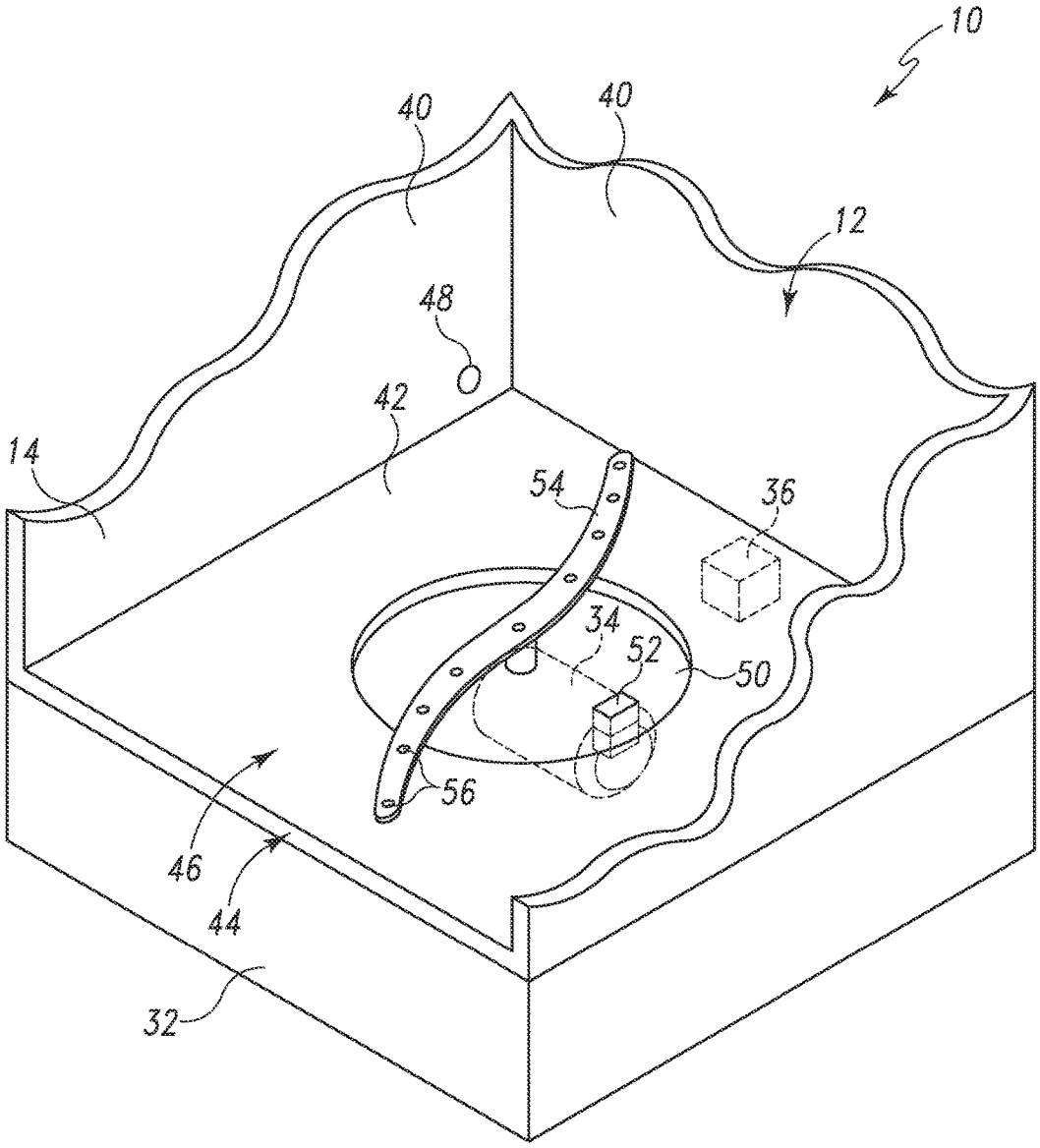
FIG. 2 is a fragmentary perspective view of the tub of the dishwashing machine of FIG. 1.

A machine compartment 32 is located below the tub 12. The machine compartment 32 is sealed from the tub 12. In other words, unlike the tub 12, which is filled with fluid and exposed to spray during the wash cycle, the machine compartment 32 does not fill with fluid and is not exposed to spray during the operation of the dishwasher 10. Referring now to FIG. 2, the machine compartment 32 houses a recirculation pump assembly 34 and the drain pump 36, as well as the dishwasher's other motor(s) and valve(s), along with the associated wiring and plumbing.

Referring now to FIG. 2, the tub 12 of the dishwasher 10 is shown in greater detail. The tub 12 includes a number of side walls 40 extending upwardly from a bottom wall 42 to define the washing chamber 14. The open front side 44 of the tub 12 defines an access opening 46 of the dishwasher 10. The access opening 46 provides the user with access to the dish racks 16 positioned in the washing chamber 14 when the door 24 is open. When closed, the door 24 seals the access opening 46, which prevents the user from accessing the dish racks 16. The door 24 also prevents fluid from escaping through the access opening 46 of the dishwasher 10 during a wash cycle.

The bottom wall 42 of the tub 12 has a sump 50 positioned therein. At the start of a wash cycle, fluid enters the tub 12 through a hole 48 defined in the side wall 40. The sloped configuration of the bottom wall 42 directs fluid into the sump 50. The recirculation pump assembly 34 removes such water and/or wash chemistry from the sump 50 through a hole 52 defined the bottom of the sump 50 after the sump 50 is partially filled with fluid.

The recirculation pump assembly 34 is fluidly coupled to a rotating spray arm 54 that sprays water and/or wash chemistry onto the dish racks 16 (and hence any wares positioned thereon). Additional rotating spray arms (not shown) are positioned above the spray arm 54. It should also be appreciated that the dishwashing machine 10 may include other spray arms positioned at various locations in the tub 12. As shown in FIG. 2, the spray arm 54 has a number of nozzles 56. Fluid passes from the recirculation pump assembly 34 into the spray arm 54 and then exits the spray arm 54 through the nozzles 56. In the illustrative embodiment described herein, the nozzles 56 are embodied simply as holes formed in the spray arm 54. However, it is within the scope of the disclosure for the nozzles 56 to include inserts such as tips or other similar structures that are placed into the holes formed in the spray arm 54. Such inserts may be useful in configuring the spray direction or spray pattern of the fluid expelled from the spray arm 54.

After wash fluid contacts the dish racks 16 and any wares positioned in the washing chamber 14, a mixture of fluid and soil falls onto the bottom wall 42 and collects in the sump 50. The recirculation pump assembly 34 draws the mixture out of the sump 50 through the hole 52. As will be discussed in detail below, fluid is filtered in the recirculation pump assembly 34 and re-circulated onto the dish racks 16. At the conclusion of the wash cycle, the drain pump 36 removes both wash fluid and soil particles from the sump 50 and the tub 12.

Figure 3:
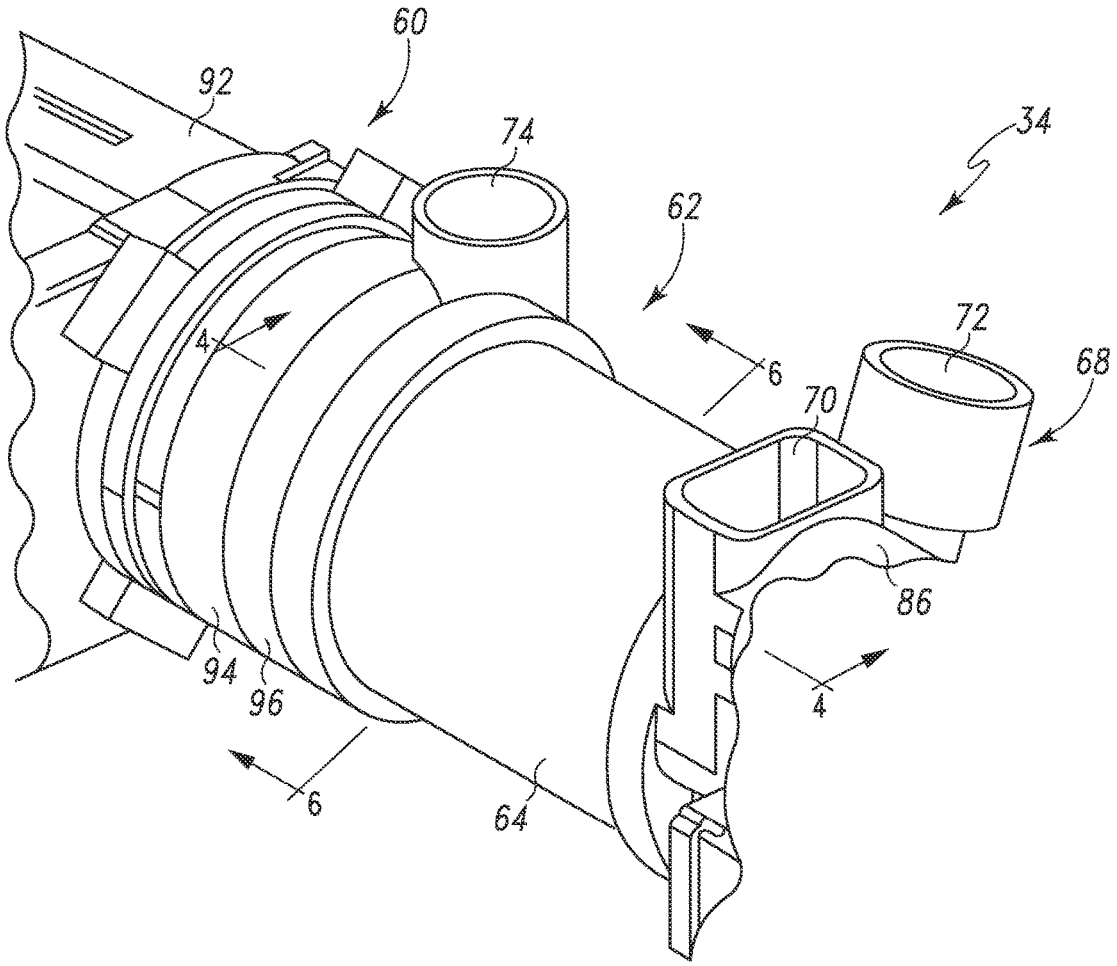
FIG. 3 is a perspective view of an embodiment of a pump and filter assembly for the dishwashing machine of FIG. 1.

Referring now to FIG. 3, the recirculation pump assembly 34 is shown removed from the dishwasher 10. The recirculation pump assembly 34 includes a wash pump 60 that is secured to a housing 62. The housing 62 includes cylindrical filter casing 64 positioned between a manifold 68 and the wash pump 60. The manifold 68 has an inlet port 70, which is fluidly coupled to the hole 52 defined in the sump 50, and an outlet port 72, which is fluidly coupled to the drain pump 36. Another outlet port 74 extends upwardly from the wash pump 60 and is fluidly coupled to the rotating spray arm 54. While recirculation pump assembly 34 is included in the dishwasher 10, it will be appreciated that in other embodiments, the recirculation pump assembly 34 may be a device separate from the dishwasher 10. For example, the recirculation pump assembly 34 might be positioned in a cabinet adjacent to the dishwasher 10. In such embodiments, a number of fluid hoses may be used to connect the recirculation pump assembly 34 to the dishwasher 10.

Figure 4:
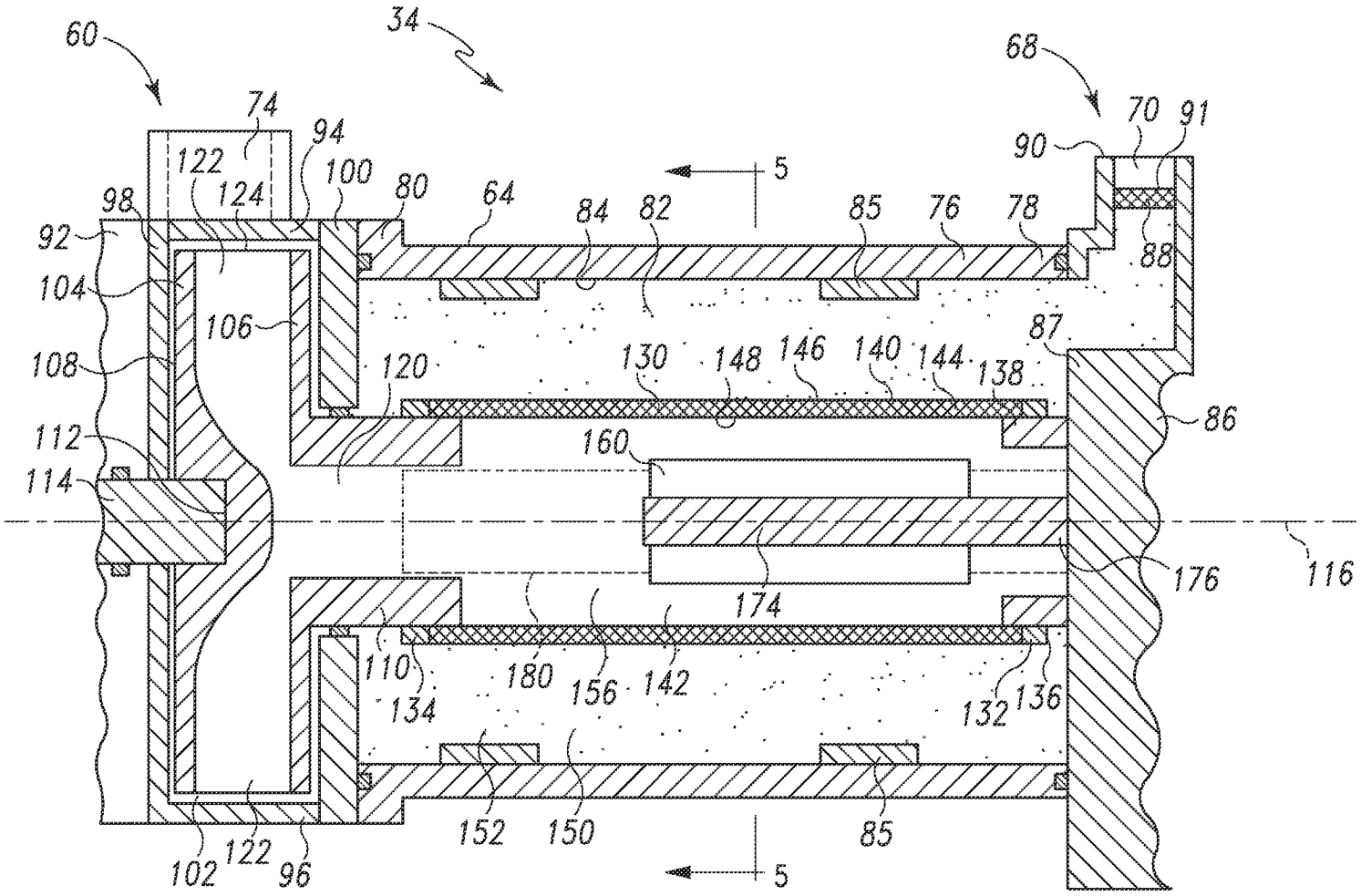
FIG. 4 is a cross-sectional view of the pump and filter assembly of FIG. 3 taken along the line 4-4 shown in FIG. 3.

Referring now to FIG. 4, a cross-sectional view of the recirculation pump assembly 34 is shown. The filter casing 64 is a hollow cylinder having a side wall 76 that extends from an end 78 secured to the manifold 68 to an opposite end 80 secured to the wash pump 60. The side wall 76 defines a filter chamber 82 that extends the length of the filter casing 64.

The side wall 76 has an inner surface 84 facing the filter chamber 82. A number of rectangular ribs 85 extend from the inner surface 84 into the filter chamber 82. The ribs 85 are configured to create drag to counteract the movement of fluid within the filter chamber 82. It should be appreciated that in other embodiments, each of the ribs 85 may take the form of a wedge, cylinder, pyramid, or other shape configured to create drag to counteract the movement of fluid within the filter chamber 82.

The manifold 68 has a main body 86 that is secured to the end 78 of the filter casing 64. The inlet port 70 extends upwardly from the main body 86 and is configured to be coupled to a fluid hose (not shown) extending from the hole 52 defined in the sump 50. The inlet port 70 opens through a sidewall 87 of the main body 86 into the filter chamber 82 of the filter casing 64. As such, during the wash cycle, a mixture of fluid and soil particles advances from the sump 50 into the filter chamber 82 and fills the filter chamber 82. As shown in FIG. 4, the inlet port 70 has a filter screen 88 positioned at an upper end 90. The filter screen 88 has a plurality of holes 91 extending there through. Each of the holes 91 is sized such that large soil particles are prevented from advancing into the filter chamber 82.

A passageway (not shown) places the outlet port 72 of the manifold 68 in fluid communication with the filter chamber 82. When the drain pump 36 is energized, fluid and soil particles from the sump 50 pass downwardly through the inlet port 70 into the filter chamber 82. Fluid then advances from the filter chamber 82 through the passageway and out the outlet port 72.

The wash pump 60 is secured at the opposite end 80 of the filter casing 64. The wash pump 60 includes a motor 92 (see FIG. 3) secured to a cylindrical pump housing 94. The pump housing 94 includes a side wall 96 extending from a base wall 98 to an end wall 100. The base wall 98 is secured to the motor 92 while the end wall 100 is secured to the end 80 of the filter casing 64. The walls 96, 98, 100 define an impeller chamber 102 that fills with fluid during the wash cycle. As shown in FIG. 4, the outlet port 74 is coupled to the side wall 96 of the pump housing 94 and opens into the chamber 102. The outlet port 74 is configured to receive a fluid hose (not shown) such that the outlet port 74 may be fluidly coupled to the spray arm 54.

The wash pump 60 also includes an impeller 104. The impeller 104 has a shell 106 that extends from a back end 108 to a front end 110. The back end 108 of the shell 106 is positioned in the chamber 102 and has a bore 112 formed therein. A drive shaft 114, which is rotatably coupled to the motor 92, is received in the bore 112. The motor 92 acts on the drive shaft 114 to rotate the impeller 104 about an imaginary axis 116 in the direction indicated by arrow 118 (see FIG. 5). The motor 92 is connected to a power supply (not shown), which provides the electric current necessary for the motor 92 to spin the drive shaft 114 and rotate the impeller 104. In the illustrative embodiment, the motor 92 is configured to rotate the impeller 104 about the axis 116 at 3200 rpm.

The front end 110 of the impeller shell 106 is positioned in the filter chamber 82 of the filter casing 64 and has an inlet opening 120 formed in the center thereof. The shell 106 has a number of vanes 122 that extend away from the inlet opening 120 to an outer edge 124 of the shell 106. The rotation of the impeller 104 about the axis 116 draws fluid from the filter chamber 82 of the filter casing 64 into the inlet opening 120. The fluid is then forced by the rotation of the impeller 104 outward along the vanes 122. Fluid exiting the impeller 104 is advanced out of the chamber 102 through the outlet port 74 to the spray arm 54.

As shown in FIG. 4, the front end 110 of the impeller shell 106 is coupled to a rotary filter 130 positioned in the filter chamber 82 of the filter casing 64. The filter 130 has a cylindrical filter drum 132 extending from an end 134 secured to the impeller shell 106 to an end 136 rotatably coupled to a bearing 138, which is secured the main body 86 of the manifold 68. As such, the filter 130 is operable to rotate about the axis 116 with the impeller 104.

A filter sheet 140 extends from one end 134 to the other end 136 of the filter drum 132 and encloses a hollow interior 142. The sheet 140 includes a number of holes 144, and each hole 144 extends from an outer surface 146 of the sheet 140 to an inner surface 148. In the illustrative embodiment, the sheet 140 is a sheet of chemically etched metal. Each hole 144 is sized to allow for the passage of wash fluid into the hollow interior 142 and prevent the passage of soil particles.

As such, the filter sheet 140 divides the filter chamber 82 into two parts. As wash fluid and removed soil particles enter the filter chamber 82 through the inlet port 70, a mixture 150 of fluid and soil particles is collected in the filter chamber 82 in a region 152 external to the filter sheet 140. Because the holes 144 permit fluid to pass into the hollow interior 142, a volume of filtered fluid 156 is formed in the hollow interior 142.

Figure 5:
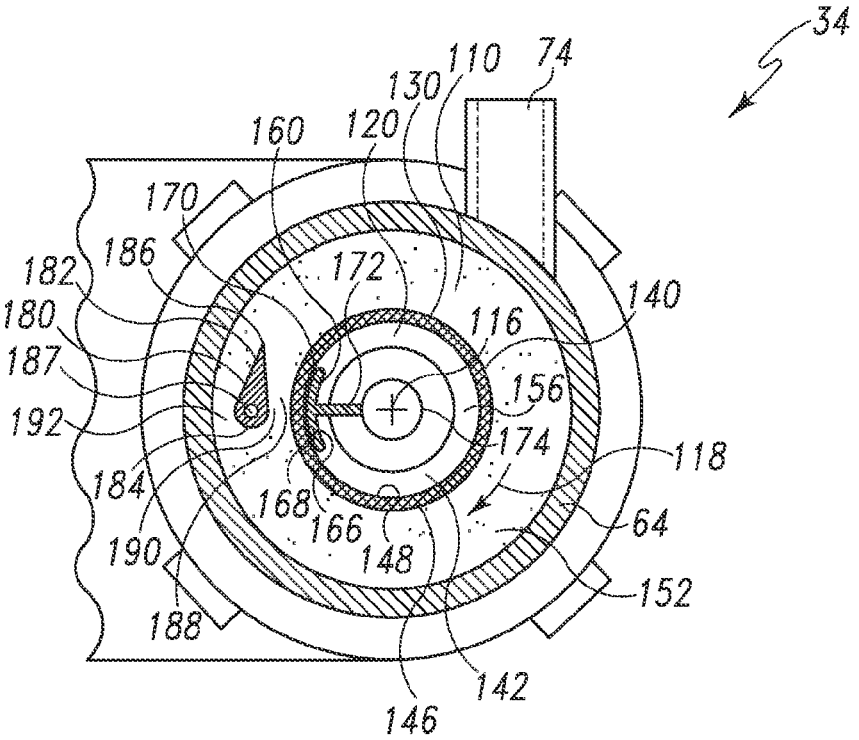
FIG. 5 is a cross-sectional view of the pump and filter assembly of FIG. 3 taken along the line 5-5 shown in FIG. 4 showing the rotary filter with two flow diverters.

Referring now to FIGS. 4 and 5, a flow diverter 160 is positioned in the hollow interior 142 of the filter 130. The diverter 160 has a body 166 that is positioned adjacent to the inner surface 148 of the sheet 140. The body 166 has an outer surface 168 that defines a circular arc 170 having a radius smaller than the radius of the sheet 140. A number of arms 172 extend away from the body 166 and secure the diverter 160 to a beam 174 positioned in the center of the filter 130. As best seen in FIG. 4, the beam 174 is coupled at an end 176 to the side wall 87 of the manifold 68. In this way, the beam 174 secures the body 166 to the housing 62.

Another flow diverter 180 is positioned between the outer surface 146 of the sheet 140 and the inner surface 84 of the housing 62. The diverter 180 has a fin-shaped body 182 that extends from a leading edge 184 to a trailing end 186. As shown in FIG. 4, the body 182 extends along the length of the filter drum 132 from one end 134 to the other end 136. It will be appreciated that in other embodiments, the diverter 180 may take other forms, such as, for example, having an inner surface that defines a circular arc having a radius larger than the radius of the sheet 140. As shown in FIG. 5, the body 182 is secured to a beam 184. The beam 187 extends from the side wall 87 of the manifold 68. In this way, the beam 187 secures the body 182 to the housing 62.

As shown in FIG. 5, the diverter 180 is positioned opposite the diverter 160 on the same side of the filter chamber 82. The diverter 160 is spaced apart from the diverter 180 so as to create a gap 188 therebetween. The sheet 140 is positioned within the gap 188.

In operation, wash fluid, such as water and/or wash chemistry (i.e., water and/or detergents, enzymes, surfactants, and other cleaning or conditioning chemistry), enters the tub 12 through the hole 48 defined in the side wall 40 and flows into the sump 50 and down the hole 52 defined therein. As the filter chamber 82 fills, wash fluid passes through the holes 144 extending through the filter sheet 140 into the hollow interior 142. After the filter chamber 82 is completely filled and the sump 50 is partially filled with wash fluid, the dishwasher 10 activates the motor 92.

Activation of the motor 92 causes the impeller 104 and the filter 130 to rotate. The rotation of the impeller 104 draws wash fluid from the filter chamber 82 through the filter sheet 140 and into the inlet opening 120 of the impeller shell 106. Fluid then advances outward along the vanes 122 of the impeller shell 106 and out of the chamber 102 through the outlet port 74 to the spray arm 54. When wash fluid is delivered to the spray arm 54, it is expelled from the spray arm 54 onto any dishes or other wares positioned in the washing chamber 14. Wash fluid removes soil particles located on the dishwares, and the mixture of wash fluid and soil particles falls onto the bottom wall 42 of the tub 12. The sloped configuration of the bottom wall 42 directs that mixture into the sump 50 and down the hole 52 defined in the sump 50.

While fluid is permitted to pass through the sheet 140, the size of the holes 144 prevents the soil particles of the mixture 152 from moving into the hollow interior 142. As a result, those soil particles accumulate on the outer surface 146 of the sheet 140 and cover the holes 144, thereby preventing fluid from passing into the hollow interior 142.

The rotation of the filter 130 about the axis 116 causes the mixture 150 of fluid and soil particles within the filter chamber 82 to rotate about the axis 116 in the direction indicated by the arrow 118. Centrifugal force urges the soil particles toward the side wall 76 as the mixture 150 rotates about the axis 116. The diverters 160, 180 divide the mixture 150 into a first portion 190, which advances through the gap 188, and a second portion 192, which bypasses the gap 188. As the portion 190 advances through the gap 188, the angular velocity of the portion 190 increases relative to its previous velocity as well as relative to the second portion 192. The increase in angular velocity results in a low pressure region between the diverters 160, 180. In that low pressure region, accumulated soil particles are lifted from the sheet 140, thereby, cleaning the sheet 140 and permitting the passage of fluid through the holes 144 into the hollow interior 142. Additionally, the acceleration accompanying the increase in angular velocity as the portion 190 enters the gap 188 provides additional force to lift the accumulated soil particles from the sheet 140.

Figure 6:
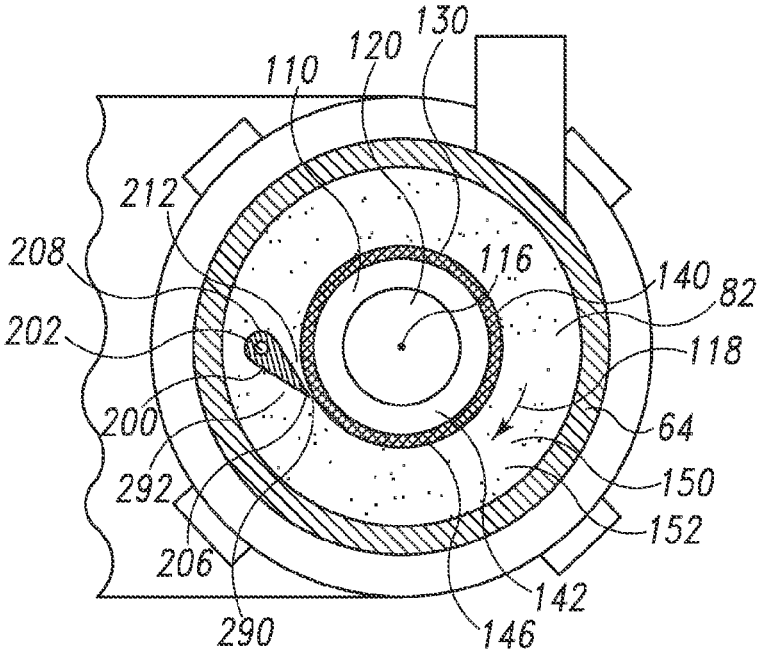
FIG. 6 is a cross-sectional view of the pump and filter assembly of FIG. 3 taken along the line 6-6 shown in FIG. 3 showing a second embodiment of the rotary filter with a single flow diverter.

Referring now to FIG. 6, a cross-section of a second embodiment of the rotary filter 130 with a single flow diverter 200. The diverter 200, like the diverter 180 of the embodiment of FIGS. 1-5, is positioned within the filter chamber 82 external of the hollow interior 142. The diverter 200 is secured to the side wall 87 of the manifold 68 via a beam 202. The diverter 200 has a fin-shaped body 204 that extends from a tip 206 to a trailing end 208. The tip 206 has a leading edge 210 that is positioned proximate to the outer surface 146 of the sheet 140, and the tip 206 and the outer surface 146 of the sheet 140 define a gap 212 therebetween.

In operation, the rotation of the filter 130 about the axis 116 causes the mixture 150 of fluid and soil particles to rotate about the axis 116 in the direction indicated by the arrow 118. The diverter 200 divides the mixture 150 into a first portion 290, which passes through the gap 212 defined between the diverter 200 and the sheet 140, and a second portion 292, which bypasses the gap 212. As the first portion 290 passes through the gap 212, the angular velocity of the first portion 290 of the mixture 150 increases relative to the second portion 292. The increase in angular velocity results in low pressure in the gap 212 between the diverter 200 and the outer surface 146 of the sheet 140. In that low pressure region, accumulated soil particles are lifted from the sheet 140 by the first portion 290 of the fluid, thereby cleaning the sheet 140 and permitting the passage of fluid through the holes 144 into the hollow interior 142. In some embodiments, the gap 212 is sized such that the angular velocity of the first portion 290 is at least sixteen percent greater than the angular velocity of the second portion 292 of the fluid.

Figure 7:
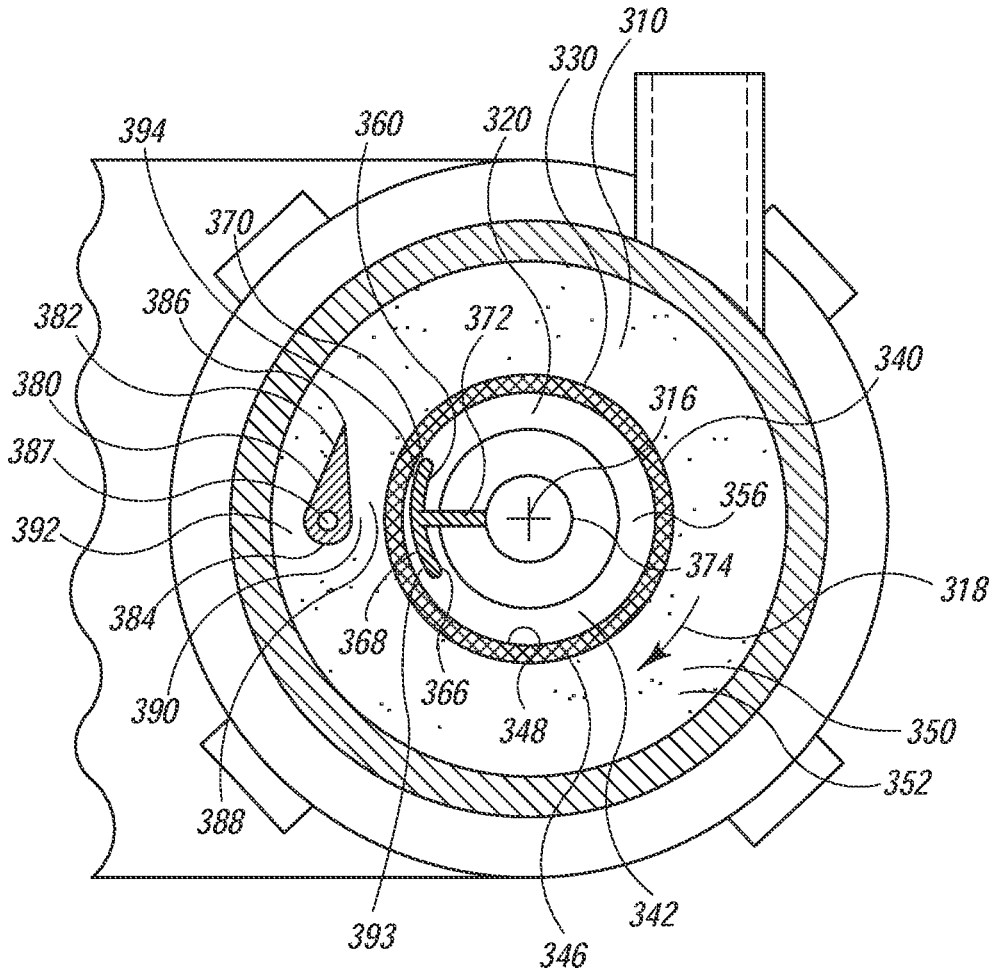
FIG. 7 is a cross-sectional elevation view of the pump and filter assembly of FIG. 3 similar to FIG. 5 and illustrating a third embodiment of the rotary filter with two flow diverters.

FIG. 7 illustrates a third embodiment of the rotary filter 330 with two flow diverters 360 and 380. The third embodiment is similar to the first embodiment having two flow diverters 160 and 180 as illustrated in FIGS. 1-5. Therefore, like parts will be identified with like numerals increased by 200, with it being understood that the description of the like parts of the first embodiment applies to the third embodiment, unless otherwise noted.

One difference between the first embodiment and the third embodiment is that the flow diverter 360 has a body 366 with an outer surface 368 that is less symmetrical than that of the first embodiment 360. More specifically, the body 366 is shaped in such a manner that a leading gap 393 is formed when the body 366 is positioned adjacent to the inner surface 348 of the sheet 340. A trailing gap 394, which is smaller than the leading gap 393, is also formed when the body 366 is positioned adjacent to the inner surface 348 of the sheet 340.

The third embodiment operates much the same way as the first embodiment. That is, the rotation of the filter 330 about the axis 316 causes the mixture 350 of fluid and soil particles to rotate about the axis 316 in the direction indicated by the arrow 318. The diverters 360, 380 divide the mixture 350 into a first portion 390, which advances through the gap 388, and a second portion 392, which bypasses the gap 388. The orientation of the body 366 such that it has a larger leading gap 393 that reduces to a smaller trailing gap 394 results in a decreasing cross-sectional area between the outer surface 368 of the body 366 and the inner surface 348 of the filter sheet 340 along the direction of fluid flow between the body 366 and the filter sheet 340, which creates a wedge action that forces water from the hollow interior 342 through a number of holes 344 to the outer surface 346 of the sheet 340. Thus, a backflow is induced by the leading gap 393. The backwash of water against accumulated soil particles on the sheet 340 better cleans the sheet 340.

Figure 8:
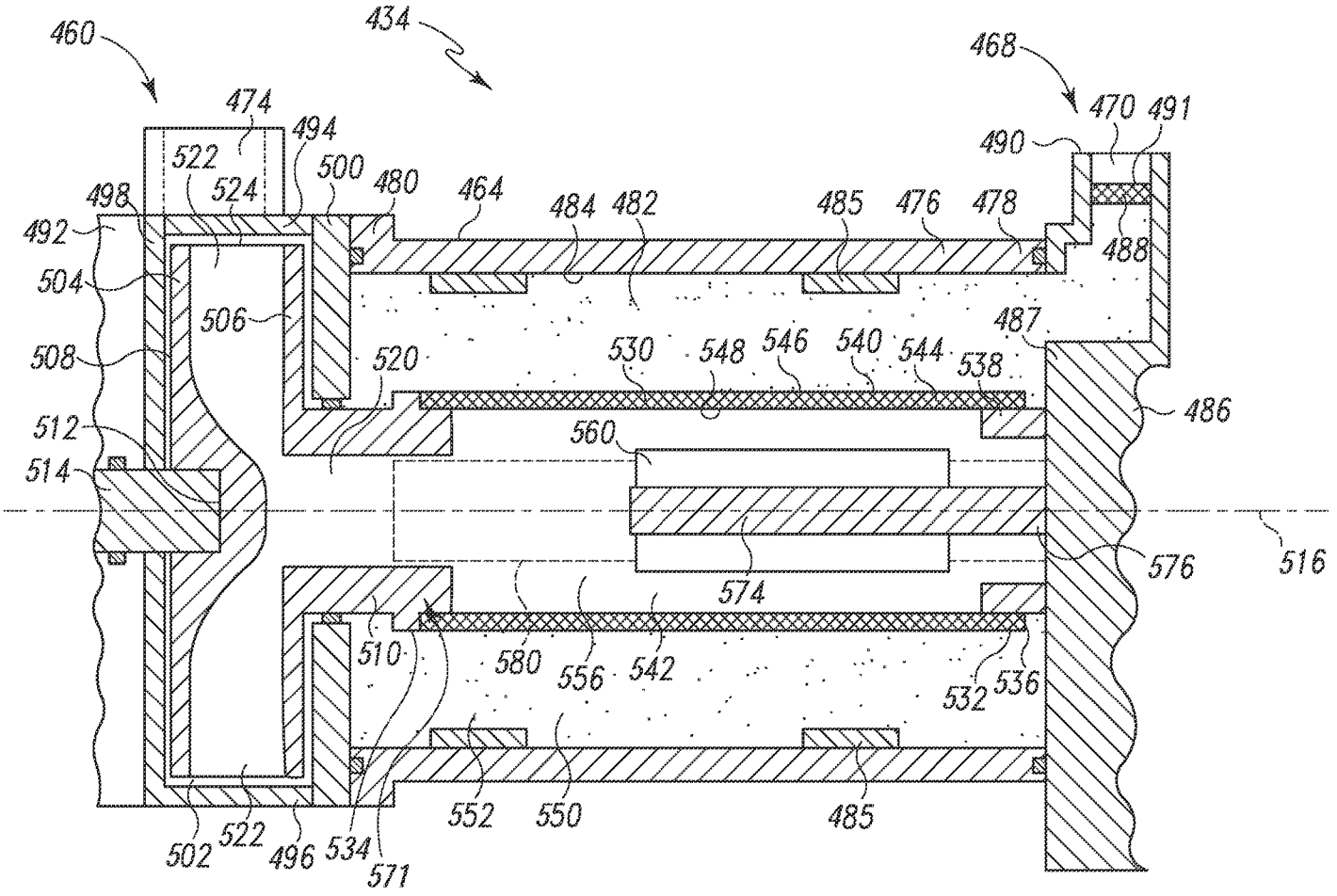
FIG. 8 is a cross-sectional view of a pump and filter assembly similar to FIG. 4 and illustrating a fourth embodiment of the invention.

FIG. 8 illustrates a fourth embodiment of a pump assembly 434 and a rotary filter 540. The fourth embodiment is similar to the first embodiment as illustrated in FIGS. 1-5. Therefore, like parts will be identified with like numerals increased by 400, with it being understood that the description of the like parts of the first embodiment applies to the fourth embodiment, unless otherwise noted.

One difference between the first embodiment and the fourth embodiment is that the front end 510 of the impeller shell 506 and the one end 534 of the rotary filter 530 are a singular piece 571. Such a singular piece 571 may be formed through injection molding. With the impeller shell 506 and the one end 534 of the rotary filter 530 being a singular piece 570 it will be appreciated that the movement of the impeller 504 causes the filter 530 to rotate and that the filter 530 rotates at the same speed about the axis 516 as the impeller 504.

Figure 9A:
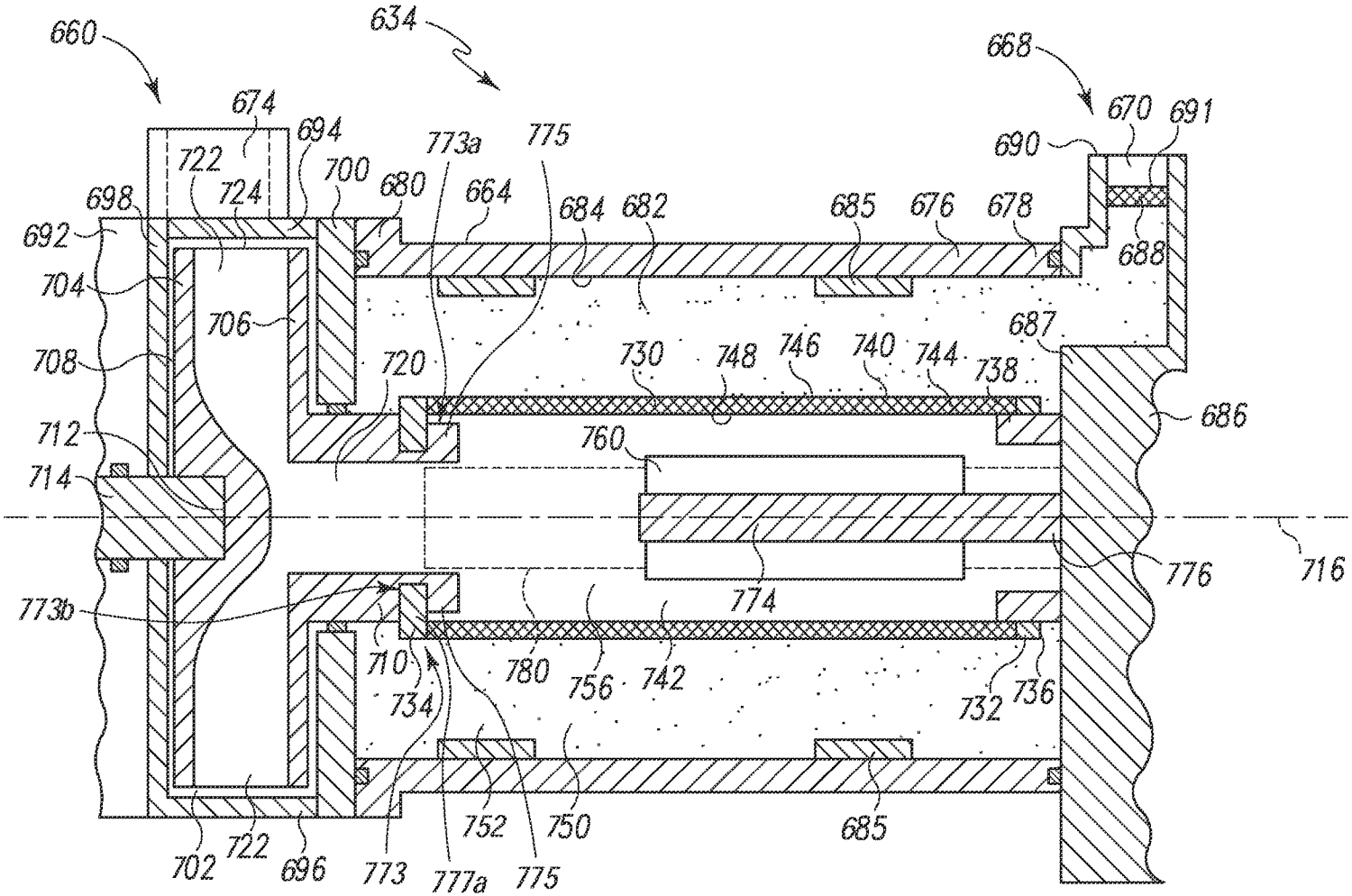
FIGS. 9A-9C illustrate a pump and filter assembly having a bayonet mount assembly according to a fifth embodiment of the invention.
Figure 9B:
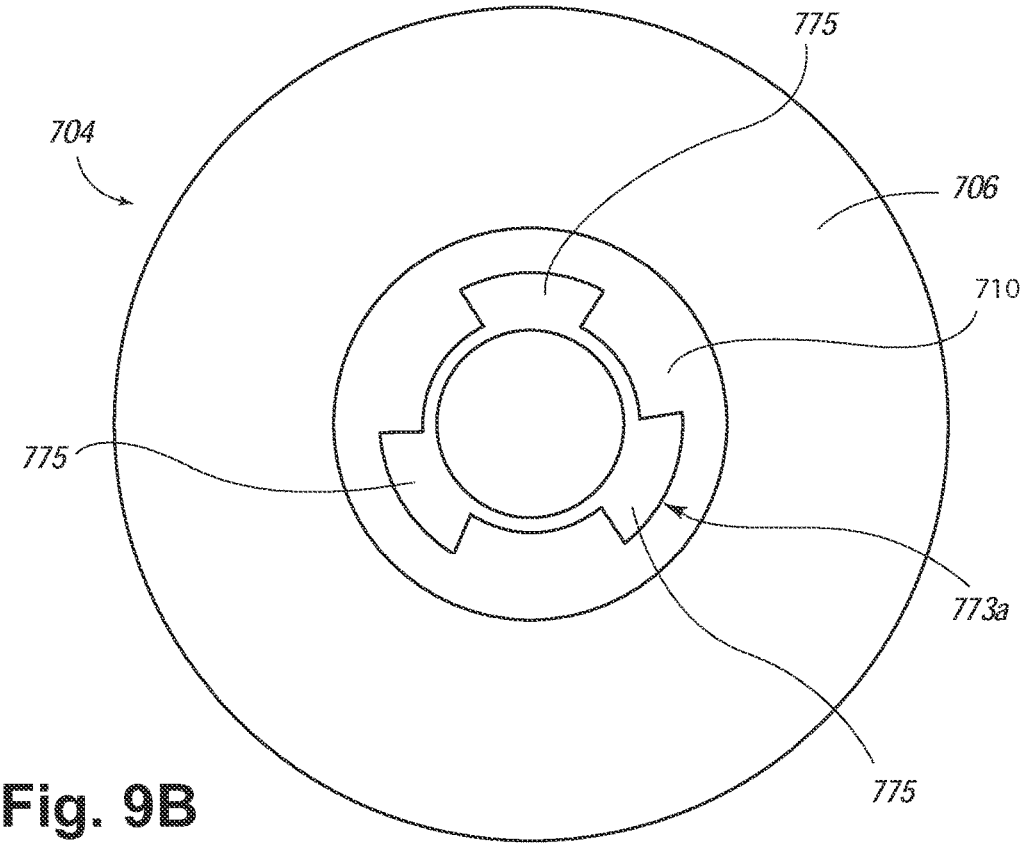
Figure 9C:
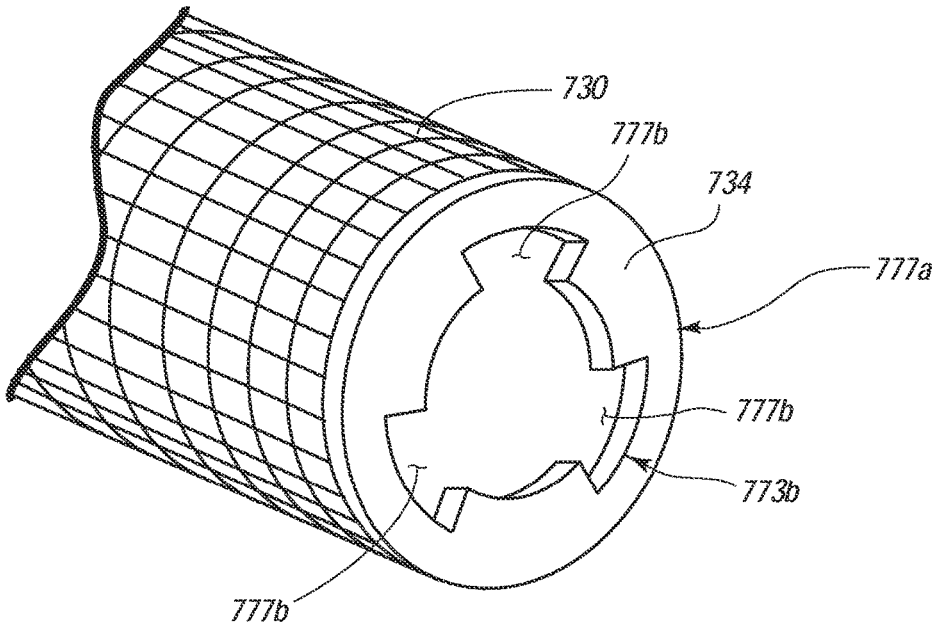

FIGS. 9A-9C illustrate a fifth embodiment of a pump assembly 634 and a rotary filter 740. The fifth embodiment is similar to the first embodiment as illustrated in FIGS. 1-5. Therefore, like parts will be identified with like numerals increased by 600, with it being understood that the description of the like parts of the first embodiment applies to the fifth embodiment, unless otherwise noted.

One difference between the first embodiment and the fifth embodiment is that the impeller 704 and the rotary filter 730 are coupled together with a bayonet mount 773 as illustrated in FIG. 9A. More specifically, the impeller shell 706 includes a male side **773*a* of the bayonet mount 773 and the rotary filter 730 includes a female side 773*b* of the bayonet mount 773, which is shaped in a manner to receive the male side 773*a*. The male side 773*a* includes a number of lugs 775 projecting from and spaced slightly from the front end 710 of the impeller shell 706. The female side 773*b* includes a plate 777*a* extending radially inward from the end 734 of the rotary filter 730**.

Preferably, the female side **773*b* of the rotary filter 730 and male side 773*a* of the impeller 704 are fastened in the same direction as rotation of the impeller 704 and filter 730. In this manner, the bayonet mount 773 will not unfasten during rotation of the impeller 704 and filter 730. Alternatively, a locking mechanism or pin (not shown) may be inserted to hold the bayonet mount 773 in place during rotation of the impeller 704 and filter 730. With the impeller shell 706 and the one end 734 of the rotary filter 730 being coupled together with the bayonet mount 773 it will be appreciated that the movement of the impeller 704 causes the filter 730 to rotate and that the filter 730 rotates at the same speed about the axis 716 as the impeller 704**.

FIG. 9B illustrates the male side **773*a* of the bayonet mount 773. As can be more clearly seen, the male side 773*a* includes a number of lugs 775 projecting from its front end 710. Although three lugs 775 have been illustrated, it has been contemplated that alternative numbers of lugs 775** may be used.

FIG. 9C illustrates more clearly the female side **773*b* of the bayonet mount 773. The plate 777*a* is illustrated as having several slots 777*b* corresponding to the lugs 775 on the male side 773*a*. The slots 777*b* of the female side 773*b* are slightly larger than the corresponding lugs 775 of the male side 773*a* such that the lugs 775 may fit into the appropriately sized slots 777*b*. Once the lugs 775 are inserted into the slots 777*b* the rotary filter 730 may be fastened to the impeller 704 by turning it a small amount such that the lugs 775 are located behind the plate 777*a* (FIG. 9A**).

Figure 10A:
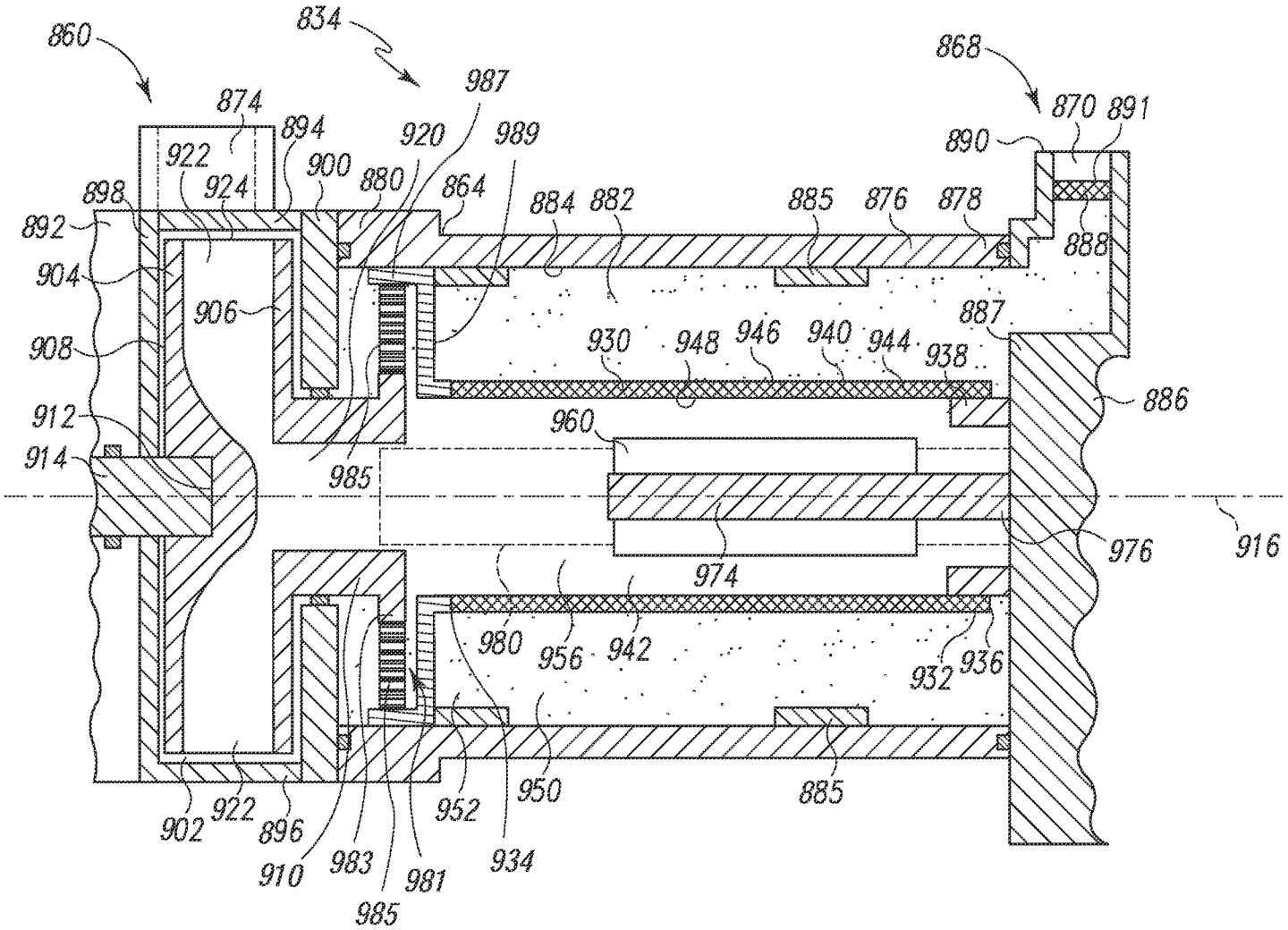
FIGS. 10A-10B illustrate a pump and filter assembly having a reduction gear assembly according to a sixth embodiment of the invention.
Figure 10B:
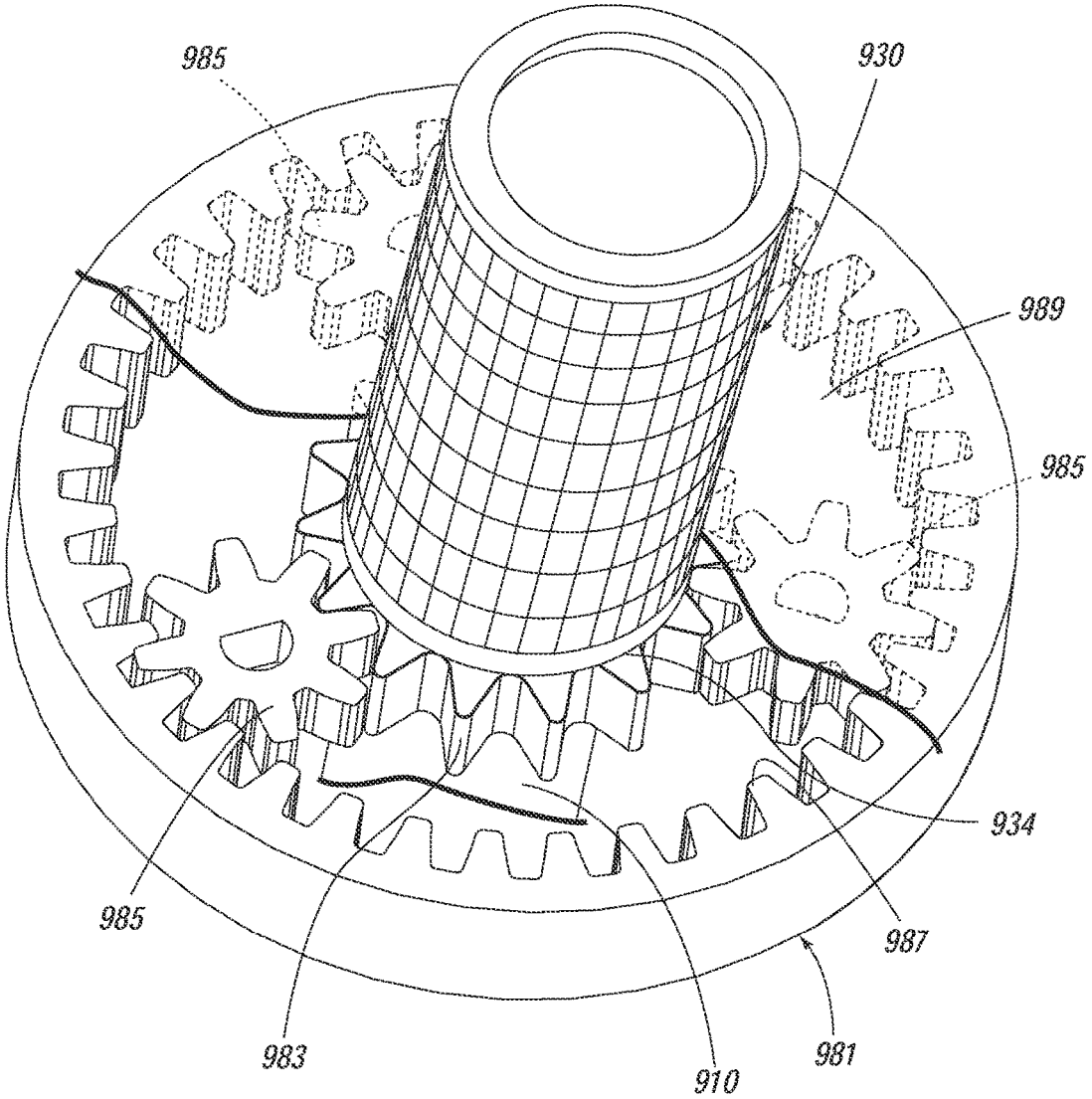

FIGS. 10A and 10B illustrate a sixth embodiment of a pump assembly 834 and a rotary filter 930. The sixth embodiment is similar to the first embodiment as illustrated in FIGS. 1-5. Therefore, like parts will be identified with like numerals increased by 800, with it being understood that the description of the like parts of the first embodiment applies to the sixth embodiment, unless otherwise noted.

Referring to FIG. 10A, one difference between the first embodiment and the sixth embodiment is that the impeller 904 and the rotary filter 930 are coupled together through a speed adjuster. As illustrated, the speed adjuster is a speed reducer illustrated as a drive assembly 981. The drive assembly 981 is composed of the front end 910 of the impeller 904, which acts as a drive shaft, a drive gear 983, idler gears 985, and a ring gear 987 having a support 989. The drive gear 983, idler gears 985, and ring gear 987 all form the speed adjuster and may be selected such that they alter the rotational speed of the filter 930 from that of the impeller 904. As the speed adjuster illustrated in FIG. 10A is a speed reducer the drive assembly 981 is assembled such that the filter 930 is rotated at a speed slower than the rotational speed of the impeller 904.

The front end 910 is operably coupled to the drive gear 983. The ring gear 987 may have a support 989 extending from it. The support 989 may be operably coupled to the end 934 of the rotary filter 930 such that movement of the ring gear 987 and the support 989 may be transferred to the rotary filter 930.

Referring to FIG. 10B, the drive gear 983 is enmeshed with the idler gears 985, which are in turn enmeshed with an outer ring gear 987. Thus, in operation, activation of the motor 892 causes the impeller 904 to rotate. The rotation of the impeller 904 in turn causes the drive gear 983 to rotate because the drive gear 983 is operably coupled to the impeller. As the drive gear 983 is rotated, the idler gears 985 are rotated and they in turn rotate the ring gear 987, which causes the filter 930 to rotate as it is mounted to the support 989 on the ring gear 987.

As the rotational speed of the impeller is relatively high (3000 rpm or higher), it is contemplated that the gear chain will form a gear reduction such that it forms a speed reducer and one rotation of the impeller 904 results in less than a full rotation of the rotary filter 930. Although the gear assembly shown is an epicyclical gear assembly; it has been contemplated that other types of gear assemblies could be used. Further, the speed adjuster may also include a speed increaser operably coupling the filter 930 to the impeller 904 such that when the impeller 904 is rotated that filter 930 is rotated at a faster speed than the impeller 904. For example, a swapping of the ring gear 987 and the drive gear 983 could provide a speed increaser, where the filter rotates faster than the impeller.

Figure 11A:
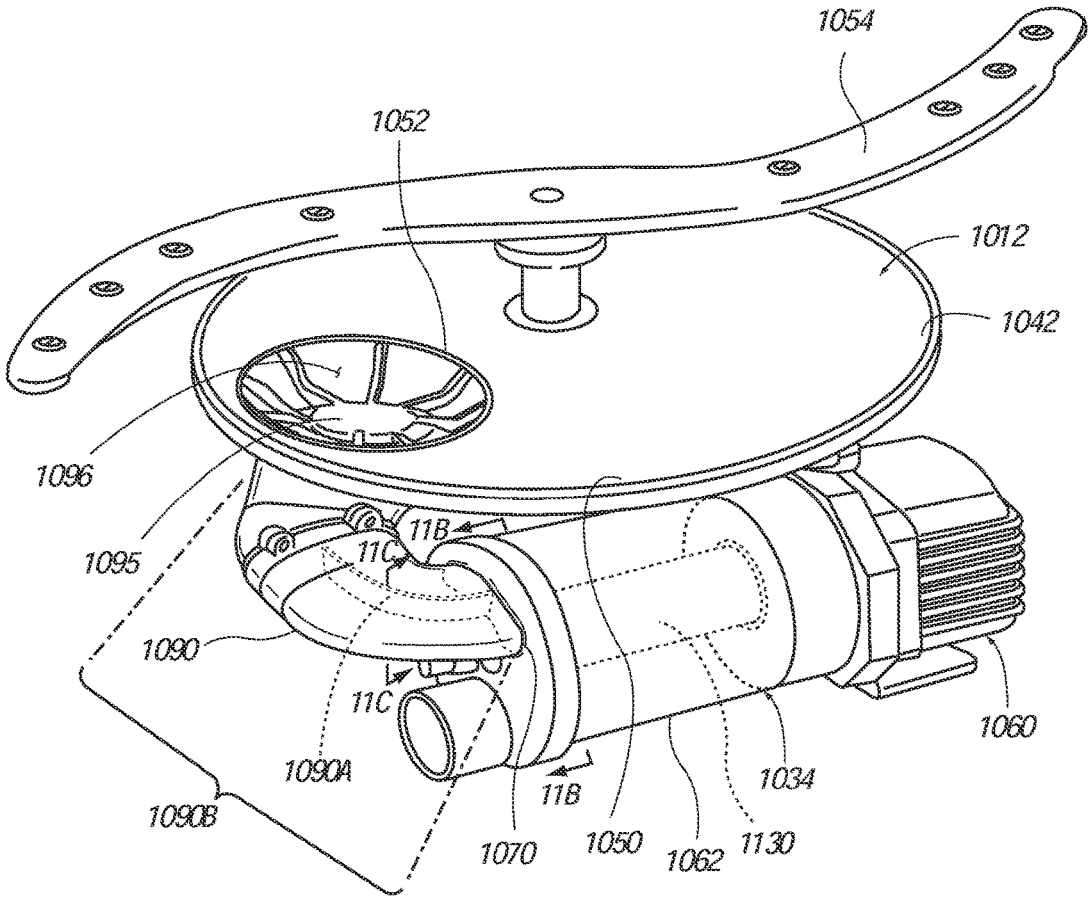
FIG. 11A is a perspective view of the sump, spray arm assembly, and pump assembly according to a seventh embodiment and removed from the dishwashing machine of FIG. 1 for clarity.

FIG. 11A illustrates a sump 1050, spray arm assembly 1054, and pump assembly 1034 according to a seventh embodiment removed from the dishwashing machine for clarity. The seventh embodiment is similar to the first embodiment as illustrated in FIGS. 1-5. Therefore, like parts will be identified with like numerals increased by 1000, with it being understood that the description of the like parts of the first embodiment applies to the seventh embodiment, unless otherwise noted.

As can be seen in FIG. 11A, a portion of the bottom wall 1042 of the tub 1012 has a sump 1050 positioned therein. An outlet 1052 defined in the sump 1050 leads to a conduit 1090. The outlet 1052 is illustrated as a cup with an open top and bottom. A pump hood or grate 1095 is located in the outlet 1052 forming the inlet of the conduit 1090. The conduit 1090 extends downwardly to an inlet port 1070 of the housing 1062 and thus fluidly couples the tub 1012 to the housing 1062. A recirculation pump assembly 1034 having a wash pump 1060 is secured to the housing 1062.

The grate 1095 has a plurality of openings 1096, which are sized such that large debris particles such as utensils, toothpicks, screws, etc. are prevented from advancing into the conduit 1090. The plurality of openings 1096 have a total cross-sectional area of about 1800 sq. mm and this provides an adequate flow rates to the wash pump 1060 that range from 25-50 liters per minute. The grate 1095 and its plurality of openings 1096 are sized and shaped so as to provide substantially non-turbulent liquid flow to the conduit 1090. More specifically, the grate 1095 eliminates any vortexes which may otherwise be formed in the conduit 1090. The grate 1095 creates a more laminar flow of liquid and decreases the turbulence of the liquid entering the conduit 1090. In this manner, the grate 1095 allows air to escape the liquid and minimizes air entrainment in the liquid. This is important as air which is entrained in the liquid reduces the efficiency of the wash pump 1060.

Figure 11B:
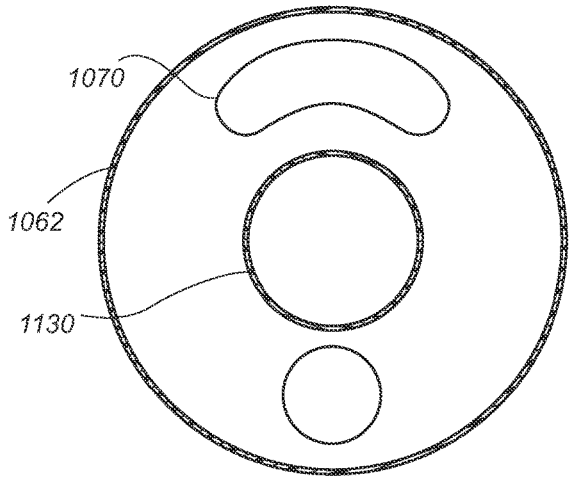
FIG. 11B is a cross-sectional view of an end of the pump assembly illustrated in FIG. 11A.

FIG. 11B illustrates an interior cross-sectional view of the end of the pump assembly 1034 where the inlet port 1070 is located. The inlet port 1070 has been illustrated as having an oblong or kidney shape. The shape of the inlet port 1070 allows liquid to enter into the chamber created by the housing 1062 outside of the rotary filter 1130 positioned therein. This allows the filter 1130 to be fluidly disposed between the inlet port 1070 and the wash pump 1060.

Figure 11C:
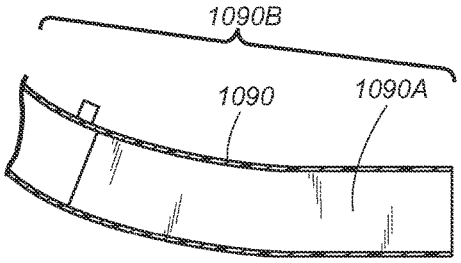
FIG. 11C is a cross-sectional view of the conduit illustrated in FIG. 11A.

Referring now to FIG. 11C, a sectional view of the conduit 1090 has been illustrated. This sectional view more clearly illustrates that the conduit 1090 from the tub 1012 to the inlet port 1070, indicated as numeral 1090B slopes downwardly. The downward slope from the tub 1012 to the inlet port 1070, indicated as numeral 1090B is approximately five degrees. The downward slope of the conduit 1090 is important as it aids in letting air escape from the housing 1062. More specifically, as the housing 1062 is filled from bottom to top the gradual slope in the conduit 1090 helps to allow air to escape from the housing 1062 as the housing 1062 is being filled with liquid.

Figure 11D:
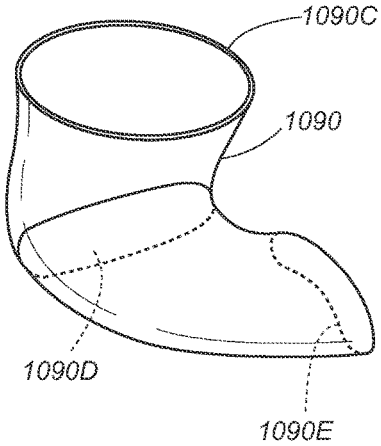
FIG. 11D is a perspective view of the conduit illustrated in FIG. 11A.

Further, as illustrated in FIG. 11D, the conduit 1090 my have a gradually-decreasing cross-sectional area. This may be seen with reference to the three cross sections illustrated as 1090C, 1090D, and 1090E. As illustrated, the cross-sectional area 1090D located at a middle portion of the conduit 1090 is smaller than the cross-sectional area 1090C at the inlet of the conduit 1090. Further, the cross-sectional area 1090E located at the end of the conduit 1090, where it feeds into the inlet port 1070, is smaller than the cross-sectional area 1090D at the middle portion of the conduit 1090. The gradual slope in the conduit 1090 and the gradually decreasing cross-sectional area cooperate to provide a slow acceleration of liquid through the conduit 1090. The slow liquid acceleration through the conduit 1090 provides time for air to escape the liquid and minimizes or eliminates air entrainment in the liquid and increases the efficiency of the wash pump 1060. It has also been contemplated that the conduit 1090 may maintain a consistent cross-sectional area through its entire length but that there may be a reduction in cross-sectional area from the outlet 1052 to the conduit 1090. Such a reduction of cross-sectional area may occur through the length of the outlet 1052 and may be approximately a 40% decrease in cross-sectional area.

Referring back to FIG. 11A, during the wash cycle, when liquid is being recirculated within the dishwasher 10 the sloped configuration of the bottom wall 1042 directs liquid into the sump 1050. The recirculation pump assembly 1034 removes such liquid and/or wash chemistry from the sump 1050 through the outlet 1052 defined in the bottom of the sump 1050. The grate 1095 acts to strain out large debris particles from the liquid before the liquid reaches the housing 1062. A divider 1090A has been illustrated as being located in the lower end of the conduit 1090 and aid in introducing the liquid into the housing 1062 in a direction that is either straight into the housing 1062 or in the same direction as the rotary filter 1130 is turning. The liquid may then be filtered by the rotary filter 1130 and re-circulated by the wash pump 1060 into the tub 1012.

There are a plurality of advantages of the present disclosure arising from the various features of the method, apparatuses, and system described herein. For example, the embodiments of the apparatus described above allow for cleaning of the filter throughout the life of the dishwasher and this maximizes the performance of the dishwasher. Thus, such embodiments require less user maintenance than required by typical dishwashers. Further, in the apparatuses described above the impeller and the filter are operably coupled such that no separate driver is needed to rotate the filter.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher comprising:

a tub defining a washing chamber for receiving dishes for cleaning; and a recirculation pump comprising:

a housing defining a chamber and having a housing inlet fluidly coupled to the tub and an outlet fluidly coupled to the tub;

an impeller rotatably mounted within the chamber and expelling liquid from the chamber through the outlet;

a motor operably coupled with the impeller to rotate the impeller; and a rotating filter fluidly disposed within the chamber between the inlet and the outlet and operably coupled to the impeller for co-rotation; and wherein the rotating filter fluidly divides the chamber into a first part that contains filtered soil particles and a second part that excludes filtered soil particles and liquid in the tub is recirculated by actuating the recirculation pump such that the liquid is drawn into the chamber through the inlet, passes through the rotating filter, and is expelled by the rotating impeller through the outlet to the tub.

2. The dishwasher according to claim 1 wherein the impeller and at least a portion of the filter are formed together to form a singular piece.

3. The dishwasher according to claim 1, further comprising a speed adjuster operably coupling the impeller to the filter to rotate the filter at a speed different than the impeller.

4. The dishwasher according to claim 3 wherein the speed adjuster includes a speed reducer operably coupling the impeller to the filter wherein when the impeller is rotated the filter rotates at a slower speed than the impeller.

5. The dishwasher according to claim 3 wherein the speed adjuster includes a speed increaser operably coupling the impeller to the filter wherein when the impeller is rotated the filter rotates at a faster speed than the impeller.

6. The dishwasher according to claim 1, further comprising a detachable mount coupling the filter to the impeller.

7. The dishwasher according to claim 6 wherein the detachable mount is a bayonet mount having a male side including lugs on one of the impeller and filter and a female side including corresponding slots on the other of the impeller and filter.

8. The dishwasher according to claim 1, further comprising a first flow diverter positioned in the chamber, the first flow diverter having a tip spaced apart from an outer surface of the filter so as to define a gap and a second flow diverter positioned within an interior of the filter, the second flow diverter having an outer surface spaced apart from an inner surface of the filter and wherein during rotation of the filter an angular velocity of fluid advanced through the gap is increased relative to the angular velocity of the fluid prior to entering the gap.

9. The dishwasher according to claim 1 wherein the impeller further comprises vanes and the vanes are operably coupled with the filter to rotate the filter as the vanes are rotated.

10. The dishwasher according to claim 1, further comprising a conduit fluidly coupling the tub to the housing inlet, wherein, in a direction from the tub to the housing inlet, the conduit slopes downwardly.

11. The dishwasher according to claim 10 wherein the conduit from the tub to the housing inlet slopes downwardly five degrees.

12. The dishwasher according to claim 10 wherein in a direction from the tub to the housing inlet, the conduit has a decreasing cross-sectional area.

13. The dishwasher according to claim 10, further comprising a grate located at an inlet of the conduit.

14. The dishwasher according to claim 13 wherein the grate has a plurality of openings, which are sized to provide substantially non-turbulent liquid flow to the conduit.

15. The dishwasher according to claim 14 wherein the plurality of openings have a total cross-sectional area of about 1800 sq. mm for a flow rate ranging from 25-50 liters per minute.

16. A dishwasher comprising:

a tub defining a washing chamber for receiving dishes for cleaning;

a sump having a housing fluidly coupled to the tub and collecting liquid supplied to the tub;

a recirculation pump comprising an impeller fluidly coupled to the sump and an outlet fluidly coupled to the tub and a motor operably coupled with the impeller to rotate the impeller; and a rotating filter fluidly separating the sump and the outlet such that the fluid on a sump side of the filter defines a first part that contains filtered soil particles and an outlet side of the filter defines a second part that excludes filtered soil particles and where the rotating filter is operably coupled to the impeller for co-rotation;

wherein liquid in the tub collects in the sump and is recirculated by actuating the recirculation pump such that the liquid in the sump is drawn through the rotating filter and is expelled through the outlet to the tub.

17. The dishwasher according to claim 16 wherein at least a portion of the filter extends into the sump.

18. The dishwasher according to claim 16 wherein the impeller and the filter are injection molded together to form a singular piece.

19. The dishwasher according to claim 16, further comprising a speed adjuster operably coupling the impeller to the filter to rotate the filter at a speed different than the impeller.

20. The dishwasher according to claim 19 wherein the speed adjuster includes a speed reducer operably coupling the impeller to the filter wherein when the impeller is rotated, the filter rotates at a slower speed than the impeller.

21. The dishwasher according to claim 19 wherein the speed adjuster includes a speed increaser operably coupling the impeller to the filter wherein when the impeller is rotated the filter rotates at a faster speed than the impeller.

22. The dishwasher according to claim 16, further comprising a detachable mount coupling the filter to the impeller.

23. The dishwasher according to claim 22 wherein the detachable mount is a bayonet mount having a male side including lugs on one of the impeller and filter and a female side including corresponding slots on the other of the impeller and filter.

24. The dishwasher according to claim 16, further comprising a first flow diverter positioned in the chamber, the first flow diverter having a tip spaced apart from an outer surface of the filter so as to define a gap and a second flow diverter positioned within an interior of the filter, the second flow diverter having an outer surface spaced apart from an inner surface of the filter and wherein during rotation of the filter an angular velocity of fluid advanced through the gap is increased relative to the angular velocity of the fluid prior to entering the gap.

25. The dishwasher according to claim 16, further comprising a conduit fluidly coupling the tub to an inlet of the housing, wherein, in a direction from the tub to the housing inlet, the conduit slopes downwardly.

26. The dishwasher according to claim 25 wherein the conduit from the tub to the housing inlet slopes downwardly five degrees.

27. The dishwasher according to claim 25 wherein in a direction from the tub to the housing inlet, the conduit has a decreasing cross-sectional area.

28. The dishwasher according to claim 25, further comprising a grate located at an inlet of the conduit.

29. The dishwasher according to claim 28 wherein the grate has a plurality of openings, which are sized to provide substantially non-turbulent liquid flow to the conduit.

30. The dishwasher according to claim 29 wherein the plurality of openings have a total cross-sectional area of about 1800 sq. mm for a flow rate ranging from 25-50 liters per minute.

31. A dishwasher comprising:

a tub defining a washing chamber for receiving dishes for cleaning; and a recirculation pump comprising:

a housing defining a chamber and having an inlet fluidly coupled to the tub and an outlet fluidly coupled to the tub;

an impeller rotatably mounted within the chamber and expelling liquid from the chamber through the outlet;

a rotating filter fluidly disposed within the chamber between the inlet and the outlet and operably coupled to the impeller for co-rotation; and a speed adjuster operably coupling the impeller to the filter to rotate the filter at a speed different than the impeller; and wherein liquid in the tub is recirculated by actuating the recirculation pump such that the liquid is drawn into the chamber through the inlet, passes through the rotating filter, and is expelled by the rotating impeller through the outlet to the tub.

32. A dishwasher comprising:

a tub defining a washing chamber for receiving dishes for cleaning;

a sump having a housing fluidly coupled to the tub and collecting liquid supplied to the tub;

a recirculation pump comprising an impeller fluidly coupled to the sump and an outlet fluidly coupled to the tub;

a rotating filter fluidly separating the sump and the outlet and operably coupled to the impeller for co-rotation; and a speed adjuster operably coupling the impeller to the filter to rotate the filter at a speed different than the impeller; and wherein liquid in the tub collects in the sump and is recirculated by actuating the recirculation pump such that the liquid in the sump is drawn through the rotating filter and is expelled through the outlet to the tub.

* * * * *